US008167273B2

(12) United States Patent
Sjostedt

(10) Patent No.: US 8,167,273 B2
(45) Date of Patent: May 1, 2012

(54) SPRING-LATCHED CONNECTION FOR TORQUE TRANSMITTING SHAFT

(75) Inventor: Rob Sjostedt, Foothill Ranch, CA (US)

(73) Assignee: Bal Seal Engineering, Inc., Foothill Ranch, CA (US)

( * ) Notice: Subject to any disclaimer, the term of this patent is extended or adjusted under 35 U.S.C. 154(b) by 373 days.

(21) Appl. No.: 12/503,328

(22) Filed: Jul. 15, 2009

(65) Prior Publication Data

US 2010/0012908 A1 Jan. 21, 2010

Related U.S. Application Data

(60) Provisional application No. 61/080,973, filed on Jul. 15, 2008.

(51) Int. Cl.
*B66D 1/26* (2006.01)

(52) U.S. Cl. ..... 254/278; 254/384; 74/545

(58) Field of Classification Search ..... 254/278, 254/384; 74/545, 546, 547, 548
See application file for complete search history.

(56) References Cited

U.S. PATENT DOCUMENTS 2,851,295 A * 9/1958 Chaffee ..... 403/328
2,896,985 A * 7/1959 Braatz ..... 403/328
3,968,953 A 7/1976 Guangorena
4,631,989 A * 12/1986 Trowbridge et al. ..... 81/62
4,883,255 A * 11/1989 Bacon ..... 254/266
5,653,149 A * 8/1997 Cavanagh ..... 74/545
5,833,217 A * 11/1998 Goldsby ..... 254/266
6,070,858 A 6/2000 Hase et al.
6,921,060 B2 * 7/2005 Weed, Jr. ..... 254/266
7,114,705 B2 * 10/2006 Steiner ..... 254/266
2004/0251454 A1 * 12/2004 Weed, Jr. ..... 254/266

OTHER PUBLICATIONS

International Search Report completed Mar. 15, 2010 and mailed Mar. 17, 2010 from corresponding International Application No. PCT/US2009/050658, filed Jul. 15, 2009 (4 pages).
Written Opinion completed Mar. 15, 2010 and mailed Mar. 17, 2010 from corresponding International Application No. PCT/US2009/050658, filed Jul. 15, 2009 (6 pages).

* cited by examiner

*Primary Examiner* — Emmanu M Marcelo
(74) *Attorney, Agent, or Firm* — Klein, O'Neill & Singh, LLP

(57) ABSTRACT

A winch is provided for taking or winding ropes, cables, and the like. The winch has a drum, a lower crown, a rope groove and an upper crown having a socket which has a fluted cavity. The fluted cavity is configured to cooperate with a pin of a winch handle, which when turned rotates the drum. In an embodiment, the fluted cavity has a groove having a canted coil spring positioned therein. The pin on the winch handle has a groove placed to correspond with the depth of the groove when placed into the socket. The combination allows the winch handle to latch to the winch and to resist unintended separation between the two.

20 Claims, 4 Drawing Sheets

SPRING-LATCHED CONNECTION FOR TORQUE TRANSMITTING SHAFT

CROSS-REFERENCE TO RELATED APPLICATION

This is a regular utility application of Ser. No. 61/080,973, filed Jul. 15, 2008, the contents of which are expressly incorporated herein by reference.

BACKGROUND

The great majority of sailboats use capstan winches to control the sails and other various control lines on the boat. The gear driven capstan winches are typically manually operated by a person turning a lever arm crank, known as a "winch handle". For safety reasons and to provide the ability to freely release a line from the capstan winch, it is necessary to remove the winch handle when not in use. This means the winch handle is typically engaged to a top socket of the winch every time the winch is used and is removed after every use. It is also desirable to sometimes leave the winch handle in the top socket for a short period of time in case a sail adjustment is anticipated.

As is well known to a skilled artisan, a winch handle that is not latched into the top socket of the capstan winch head properly poses safety hazards including injuries to the handler when it comes loose or dislodges from the top socket during use. Additionally, winches are often mounted on the side of a mast or bulkhead surface so the winch handle could fall out and be lost overboard if not properly latched.

Companies that manufacture capstan winches and winch handles have spent a great amount of time developing latching mechanisms to hold the winch handle in place. The most common type of winch handle latch involves a rotating plate that locks the handle to the winch head. The operator must move a lever arm to release the rotating latch. The release lever must be actuated to insert the handle into position and to remove the handle. Although designed to provide latching, sailors are often frustrated by the mechanism when trying to engage or disengage the latching handle during time sensitive sailing maneuvers or when racing against other sailboats.

Also commercially available is a ball and detent latch mechanism that is claimed to be easier and faster to operate. However, a latch and holding device that is less demanding or does not require the operator to operate to engage or disengage the winch handle would be more advantageous. Winches of this type are equally advantageous in other applications and industries that utilize rotary applications, particularly for such connections that allow for the transmission of torque while concurrently employing easy connect and/or disconnect means.

SUMMARY

An aspect of the present invention comprises a method for increasing a force necessary to remove a winch handle from a winch. The method comprises fixing relative rotation between the winch and the winch handle by providing mating fluted surfaces between the winch handle and the winch and deflecting a plurality of coils of a canted coil spring when moving the winch handle axially relative to the winch.

The present invention may also be practiced by providing a method for rotating a winch involving placing a portable drive mechanism into rotational communication with the winch and engaging a pin to a socket of the drive mechanism and the winch such that a canted coil spring located in a groove of the socket increases a force necessary to remove the pin from the socket.

A still further aspect of the present invention includes a rotary application assembly for torque transmission. In an embodiment, the assembly comprises a rotatable flange and a socket having an opening extending through the rotatable flange. The socket comprising a plurality of fluted surfaces and a groove intersecting each of the fluted surfaces and having a canted coil spring positioned therein. The groove comprises a bottom surface and two side surfaces and said rotatable flange being rotatable by a shaft having corresponding fluted surfaces.

A yet further aspect of the present invention is a winch comprising a drum having an upper crown and a socket. The socket comprising a plurality of fluted cavities and a groove intersecting each of the fluted cavities and having a canted coil spring positioned therein. The groove comprising a bottom surface and two side surfaces.

A still yet further aspect of the present invention is a method for transmitting a torque from a first component to a second component. The method comprises inserting a shaft through a flange and into a socket. The socket comprises fluted surfaces and a groove intersecting each of the fluted surfaces. The shaft comprises fluted surfaces and a groove. The method further includes the step of rotating said shaft and said flange, and wherein a canted coil spring is positioned between the groove of the shaft and the groove of the socket.

Other aspects of the present invention are provided which will become apparent when read in full in combination with the attached accompanied figures.

DETAILED DESCRIPTION

The detailed description set forth below in connection with the appended drawings is intended as a description of the presently preferred embodiments of capstan winches (herein "winch" or "winches") provided in accordance with aspects of the present invention and is not intended to represent the only forms in which the present invention may be constructed or utilized. The description sets forth the features and the steps for constructing and using the winches of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like or similar elements or features.

Figure 1:
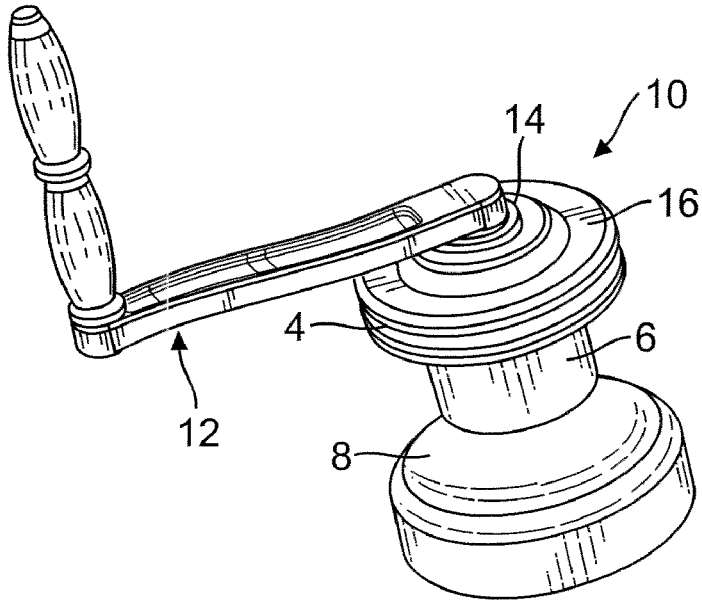
FIG. 1 is a perspective view of a combination winch and winch handle provided in accordance with aspects of the present invention.
Figure 2:
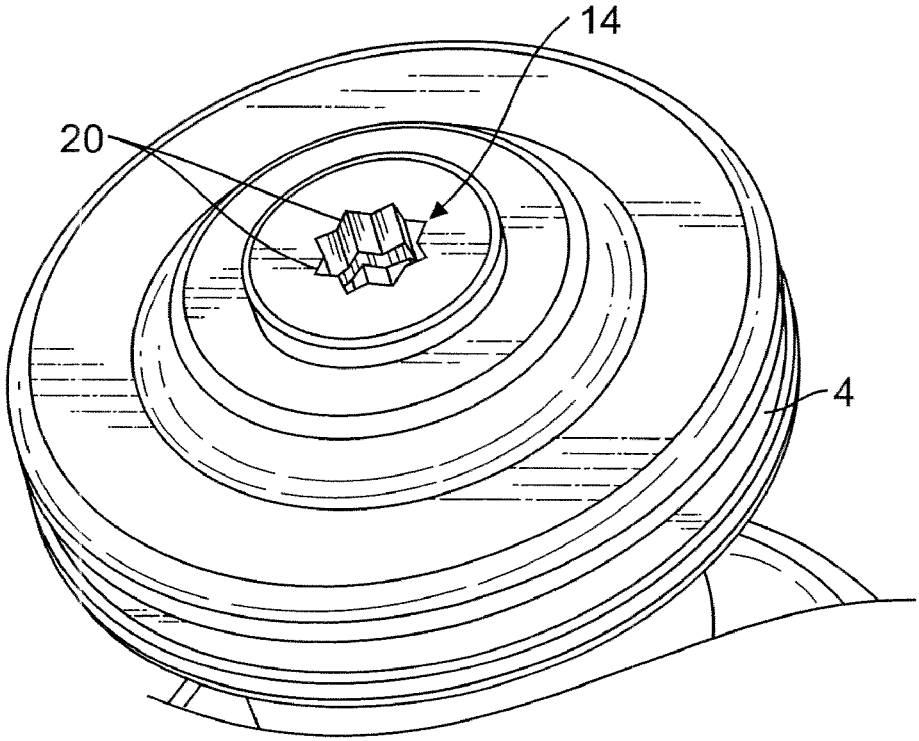
FIG. 2 is a closed-up view of a top socket of the winch of FIG. 1.
Figure 3:
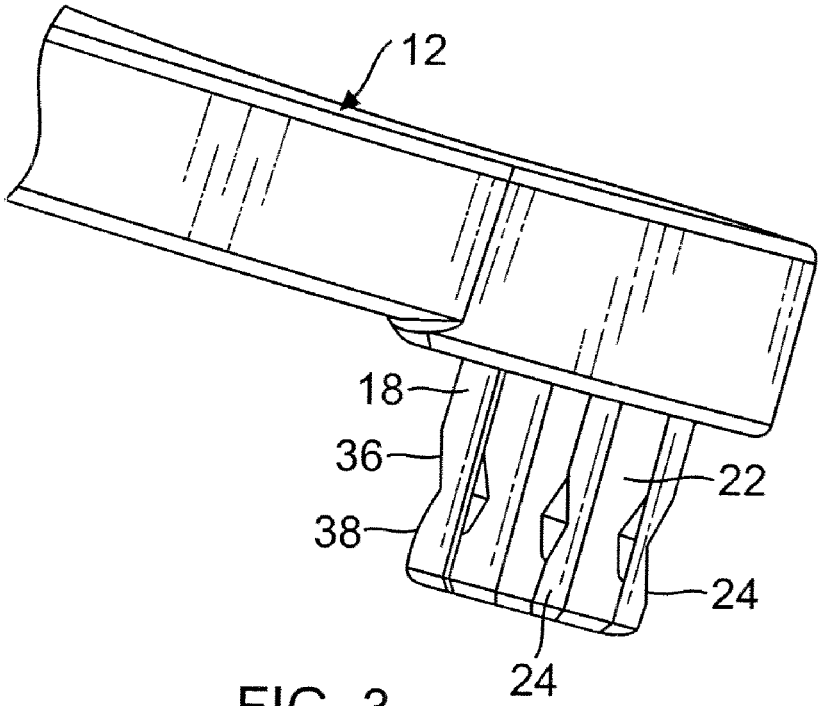
FIG. 3 is a closed-up view of the winch handle of FIG. 1.

Referring now to FIG. 1, a perspective view of a capstan winch 10 having a winch handle 12 engaged to a top socket 14 of an upper crown 16 is shown, which has a rotatable structure or flange for rotating about an axis. The winch 10 also has a rope socket 4, a drum 6, and a lower crown 8. The top socket 14 of the winch 10 is fluted, has at least one but preferably a plurality of fluted cavities 20 (FIG. 2), and is configured to engage the fluted surface 22 of the pin 18 (FIG. 3) of the winch handle 12, which has corresponding fluted ridges 24. The socket is either a part of or is in mechanical communication with a drive shaft for rotating a gear drive system, as is well known in the art. The socket may also be part of the flange or is part of a structure that is connected so that the socket is in communication with an opening on the flange. The engagement between the fluted surfaces fixes relative angular rotation between the handle and the winch by providing direct mechanical interference so that when the handle is rotated to impart a torque, it rotates the winch. Axially, the engagement permits easy assembly/disassembly for quick or frequent connect/disconnect by allowing easy axial separation by the pin relative to the socket.

Figure 5:
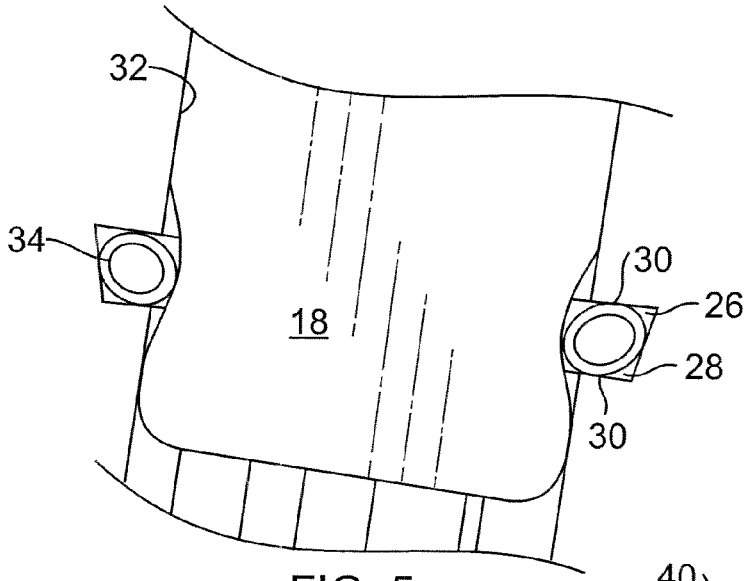
FIG. 5 is a closed-up cross-sectional side view of the engagement between the winch handle and the winch of FIG. 1.
Figure 6:
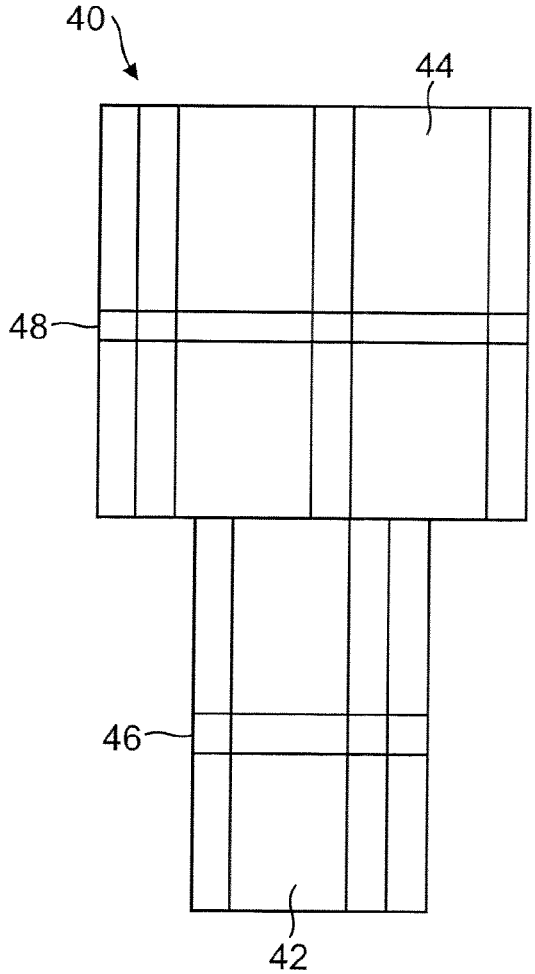
FIG. 6 is a side view of a socket adaptor provided in accordance with an alternative embodiment of the present invention.

In one embodiment, a groove 26 is cut approximately mid way down the female fluted receiving socket 14 of the winch head, although a cut at a greater depth or a shallower depth may be practiced without deviating from the spirit and scope of the present invention. As is more clearly shown in FIG. 5, the groove 26 has a bottom surface 28 and two side surfaces 30 and may be cut so that the bottom surface is angled relative to the wall surface 32 of the socket. The bottom surface 28 may alternative have a V-bottom configuration, similar to that shown in FIG. 5 for the pin. Still alternatively, the bottom surface 28 may be flat or generally parallel to the wall surface 32. Selection of a particular angle of the bottom surface relative to the socket wall surface 32 will force the canted coil spring 34 to rotate to a desired rest position in the groove 26, which angle surface enables a designer to control the connect and disconnect forces of the pin 18 when it engages or disengages from the top socket 14. The groove 26 and the spring disposed therein are preferably oriented along a perpendicular plane or planes to the direction of insertion of the pin. Alternatively or in addition thereto, certain canted coil spring characteristics, such as spacing between coils, wire diameter size, wire shape, wire material, etc., may be selected so that different forces are required to deflect the spring, which in turn allows a designer to control connect and disconnect forces of the pin moving relative to the socket. Canted coil springs are available from Bal Seal Engineering of Foothill Ranch, Calif.

A notch or groove 36 (FIG. 3) is machined in the male fluted section 18 of the winch handle 12 that corresponds to the engaged location of the canted coil spring 34, i.e., the groove 26. In one embodiment, the notch 36 is generally V-shape having symmetrical tapered surfaces of the apex of the notch. In other embodiments, the surfaces have different tapered angles relative to the remaining surface of the pin. In another embodiment, the angle of the lower tapered surface 38 of the notch (FIG. 3) is selected to provide a desired release force when retracting the pin 18 from the socket 14. This may be practiced by increasing the angle to increase the release force and decreasing the angle to decrease the release force.

Figure 4:
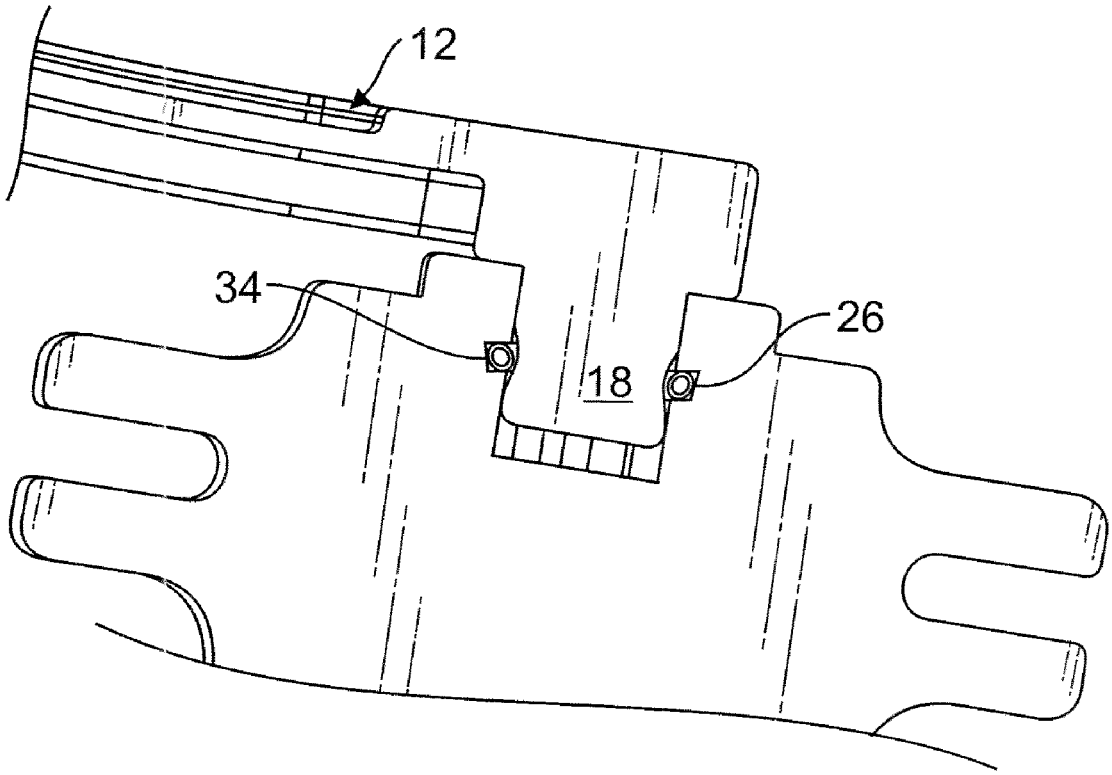
FIG. 4 is a schematic cross-sectional side view of the engagement between the winch handle and the winch of FIG. 1.

When the winch handle 12 is inserted into the winch socket 14 (FIGS. 4 and 5), the male fluted engagement pin deflects the canted coil spring 34. When the winch handle is fully inserted into the capstan winch body, the canted coil spring engages with the machined groove in the winch handle drive pin and holds the handle in place and prevents most if not all unintended disengagement. No manually operated release mechanism is required aside from simply retracting the pin. The canted coil spring provides adequate retention of the handle and resists separation due to events such as vibration, accidental and unexpected contacts, or change in assembly orientation while still allowing frequent assembly/disassembly and quick adjustability. For example, the engagement provides a latch in the axial direction when the male shaft is inserted into a receiving socket to resist unintended separation as compared to, for example, when no canted coil spring is used for a rotary application involving torque transmission.

In other embodiments involving a shaft that transmits rotation and torque to another part in a mechanical assembly in a connection that requires the shaft to be inserted into a corresponding cutout geometry easily and disconnect easily, the same retention benefit may be realized by incorporating a groove for retaining one or more canted coil springs and a matching groove on the mated part. Examples could include a splined drive axel driven by a drive train gear in automotive applications, wherein the drive gear consists of the corresponding spline geometry along the inner diameter. Another application is for raising and lowering overhead mounted blinds, screens, or shades by inserting a rod into a gear system and then turning the gears to lower or raise the blinds, screens, or shades.

Thus, an aspect of the present invention is a combination winch and winch handle having simple latching between the two without manually operated latching or releasing mechanism. Another aspect of the present invention is a combination winch and winch handle having ridges for fixing relative rotation between the two and grooves having a spring located therebetween for increasing a force that is required to remove the pin from the socket relative to the same pin and socket without the spring. In yet another aspect of the present invention, there is provided a capstan winch having a drum, a rope groove, and a fluted socket having a groove comprising a bottom surface and two side surfaces. In a preferred embodiment, a canted coil spring, which may be an axially canted coil spring or a radially canted coil spring, is disposed in the groove. In still yet another aspect of the present invention, a winch handle is provided having a spindle, an arm, and a pin having a fluted surface and at least one fluted ridge, and wherein the fluted surface of the pin comprises a notch. In a preferred embodiment, the notch comprises a lower bottom surface and two side walls, which may have the same or dissimilar angles relative to an axis of the pin. In still yet another aspect of the present invention, the pin or shaft 18 includes a groove for retaining a canted coil spring.

A still further feature is a combination pin and groove in a rotary drive system in which a torque is transmitted by the pin to the groove, or vice versa, and the pin is coupled to the groove by axially inserting the pin into the groove. Said combination further comprises corresponding grooves having a canted coil spring disposed therein and corresponding cutout geometries for direct mechanical interference. As used herein, axial direction is understood to mean in the direction of insertion or removal of the pin from the socket and radial direction or rotational direction is understood to mean around the axis of insertion or removal of the pin or spaced radially away from the axis of rotation of the pin, which may be coaxial or coincident with the axis of the pin.

In an alternative embodiment, a socket adaptor 40 is provided comprising a fluted lower pin 42, similar to the fluted pin 18 on the winch handle, and an upper fluted pin 44. The fluted lower pin 42 has a notch 46 and is configured to latch with the grooved winch socket 14 of FIGS. 4 and 5, similar to the winch handle of FIGS. 3-5. The upper fluted pin 44 of the socket adaptor 40 may have a similar fluted surface and a larger cross-sectional diameter compared to the lower pin. Alternatively, the upper fluted pin may resemble a hex-head, similar to a screw bolt, or other shapes or configurations designed to engage a socket. In one embodiment, the upper fluted pin 44 incorporates a groove 48 for accommodating a canted coil spring, similar to the groove 26 of FIG. 5. Thus, the socket adaptor 40 is configured to convert the winch socket 14 of a winch to one having a surface having a male projection for engaging with a modified winch handle having a socket instead of a pin. The socket of the modified winch handle preferably incorporates a notch or groove placed and dimensioned within the socket for engaging the canted coil spring located on the upper fluted pin 44. As is readily apparent to a person of ordinary skill in the art, this allows a designer to incorporate gearing or ratchet mechanism with the modified winch handle for added maneuverability and functionality in manipulating the winch.

Thus, other aspects of the present invention is a provision for an adaptor for converting a winch for use with a winch handle having a pin to a winch for use with a winch handle having a female socket. In a further aspect of the present invention, the adaptor has an upper pin section and a lower pin section having different cross-sectional dimensions and wherein each of the two pin sections incorporates a groove having a plane that intersects the longitudinal axis of the adaptor.

Over and above the basic latching feature without complex mechanisms, the canted coil spring can be tailored to provide the desired insertion and removal force that prevents the pin from inadverantly becoming disengaged but retains operator convenience. The simple spring latch is integral with the capstan winch and is less likely to be damaged or sustain mechanical failure. The spring latch holds the handle in place but also automatically releases in an emergency in case a line was trapped under the handle. The spring latch is lower cost than other mechanisms that hold the handle in place and the spring is not subject to freezing up due to salt water corrosion and requires little or no maintenance.

In addition to providing engagement and retention of a winch handle into a winch, another embodiment of this invention involves use of the principles to temporarily hold a portable winch power drive system into the winch for operation. Portable winch power drive units have an electric motor and gear box drive system so that the operator does not need to manually crank the winch handle. Winch power drive units engage into the winch in the same manner as a winch handle. The canted coil spring provides suitable retention of the power drive unit during operation.

Figure 7A:
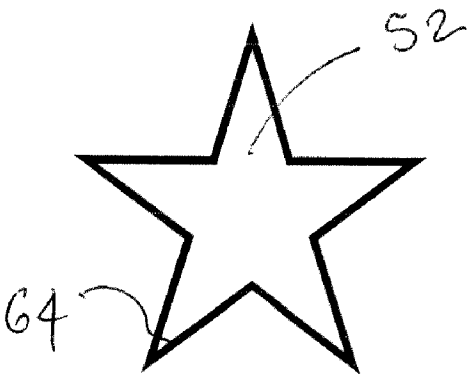
FIGS. 7A-7F are schematic cross-sectional views of various alternative geometries.
Figure 7B:
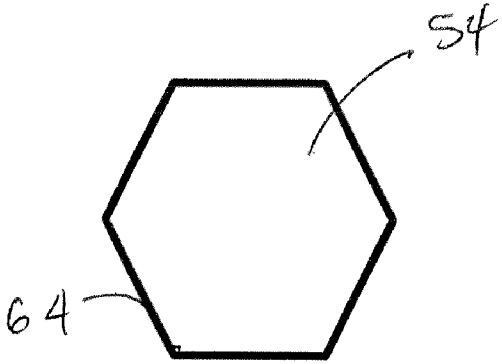
Figure 7C:
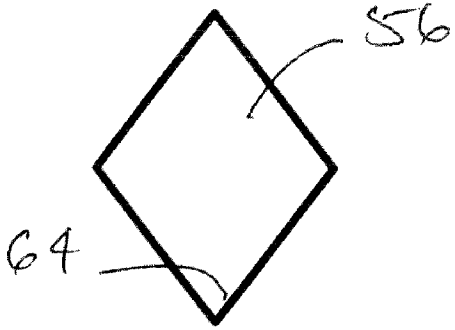
Figure 7D:
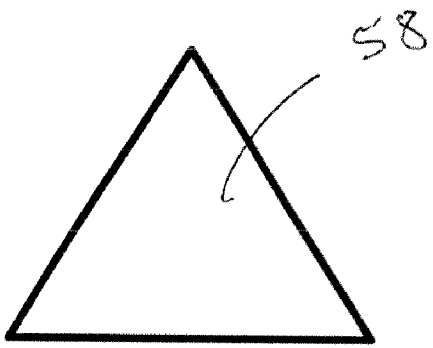
Figure 7E:
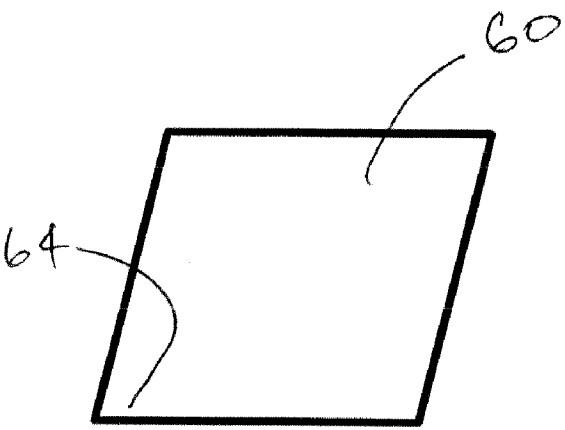
Figure 7F:
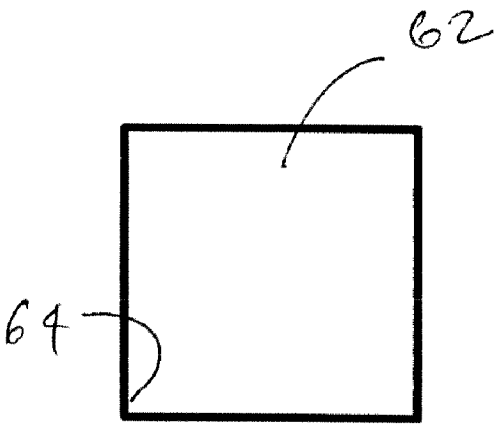

With reference now to FIGS. 7A-7F, various cross-sectional geometries may be used for the companion pin and socket of the present invention. FIG. 7A shows a star shape geometry 52. FIG. 7B shows a hexagon or polygon shape 54 geometry. FIG. 7C shows a diamond shape geometry 56. FIG. 7D shows a triangle shape geometry 58. FIG. 7E shows a rhombus shape geometry 60, which may also be considered a quadrilateral. FIG. 7F shows a square shape geometry 62. Each of the corners 64 of the various shaped pin or socket may be called or is considered a fluted surface. However, the invention is not limited to the geometries shown as other shapes may be adapted by a person of ordinary skill in the art that provides direct mechanical interference.

Although limited embodiments of the capstan winch, its components, and other applications involving a pin and socket for angular torque transmission have been specifically described and illustrated herein, many modifications and variations will be apparent to those skilled in the art. For example, the retention mechanism comprising a canted coil spring may be incorporated in one, two or greater than two-speed winches, may be made with multiple grooves for retaining more than one canted coil spring, or may be used in combination with other retention mechanisms. The same pin to socket arrangement for torque transmission may also be made from conductive materials to permit current flow between the components. In yet another embodiment, the groove and/or notch geometries provide a locking connection such the pin cannot be removed from the groove without destroying or permanently deforming the canted coil spring. Still alternatively, the groove and/or notch geometries provide a holding connection through friction forces between the canted coil spring and the component, which may be the groove or the pin depending on the location of the spring. Also, although certain features are described relative to a particular embodiment, it is stood that the same may be used for other embodiments not specifically discussed provided the interchangeability produces a contemplated functional result. Accordingly, it is to be understood that the capstan winch and their components constructed according to principles of this invention may be embodied other than as specifically described herein. The invention is also defined in the following claims.

What is claimed is:

1. A rotary application assembly for torque transmission comprising a rotatable flange and a socket having an opening extending through the rotatable flange: said socket comprising a plurality of fluted surfaces and a groove intersecting each of the fluted surfaces and having a canted coil spring positioned therein; wherein said groove comprises a bottom surface and two side surfaces and said rotatable flange being rotatable by a shaft having corresponding fluted surfaces.

2. The rotary application assembly of claim 1, further comprising a second groove intersecting each of the fluted surfaces in said socket.

3. The rotary application assembly of claim 2, further comprising a second canted coil spring positioned in said second groove.

4. The rotary application of claim 2, further comprising a shaft coupled to said socket and having fluted surfaces.

5. The rotary application of claim 1, wherein said socket has a wall surface and wherein said bottom surface is angled to the wall surface of the socket.

6. The rotary application of claim 1, wherein said rotatable flange is an upper crown of a capstan winch and said socket is formed with said rotatable flange.

7. The rotary application of claim 1, wherein the socket has a configuration of at least one of a star shape geometry, a hexagon shape geometry, a polygon shape geometry, a diamond shape geometry, a triangle shape geometry, a rhombus shape geometry, a quadrilateral shape geometry, and a square shape geometry.

8. A winch comprising a drum having an upper crown and a socket, said socket comprising a plurality of fluted cavities and a groove intersecting each of the fluted cavities and having a canted coil spring positioned therein, said groove comprising a bottom surface and two side surfaces.

9. The winch of claim 8, further comprising a winch handle.

10. The winch of claim 8, wherein the drum comprises a groove for retaining a rope.

11. The winch of claim 8, further comprising a second groove in said socket.

12. The winch of claim 8, wherein the socket has a configuration of at least one of a star shape geometry, a hexagon shape geometry, a polygon shape geometry, a diamond shape geometry, a triangle shape geometry, a rhombus shape geometry, a quadrilateral shape geometry, and a square shape geometry.

13. The winch of claim 8, wherein said socket has a wall surface and wherein said bottom surface is angled to the wall surface of the socket.

14. A method for transmitting a torque from a first component to a second component comprising:

inserting a shaft through a flange and into a socket, wherein said socket comprising fluted surfaces and a groove intersecting each of the fluted surfaces and said shaft comprising fluted surfaces and a groove;

rotating said shaft and said flange; and wherein a canted coil spring is positioned between the groove of the shaft and the groove of the socket.

15. The method of claim 14, wherein the groove comprises a bottom wall surface and two side wall surfaces.

16. The method of claim 14, further comprising a second groove in said socket.

17. The method of claim 14, wherein the flange is an upper crown of a capstan winch.

18. The method of claim 14, wherein the socket has a configuration of at least one of a star shape geometry, a hexagon shape geometry, a polygon shape geometry, a diamond shape geometry, a triangle shape geometry, a rhombus shape geometry, a quadrilateral shape geometry, and a square shape geometry.

19. The method of claim 14, wherein the spring is located in the groove of the shaft.

20. The method of claim 14, wherein the spring is located in the groove of the socket.

* * * * *

UNITED STATES PATENT AND TRADEMARK OFFICE

CERTIFICATE OF CORRECTION

PATENT NO. : 8,167,273 B2
APPLICATION NO. : 12/503328
DATED : May 1, 2012
INVENTOR(S) : Rob Sjostedt It is certified that error appears in the above-identified patent and that said Letters Patent is hereby corrected as shown below:

On the Title page, in "Primary Examiner", in column 2, line 1, delete "Emmanu" and insert -- Emmanuel --, therefor.

In column 5, line 33, delete "inadverantly" and insert -- inadvertently --, therefor.

In column 6, line 31, in Claim 1, delete "flange:" and insert -- flange; --, therefor.

Signed and Sealed this
Fourth Day of December, 2012

David J. Kappos

David J. Kappos
*Director of the United States Patent and Trademark Office*